US008285186B2

(12) United States Patent
Matsubara et al.

(10) Patent No.: US 8,285,186 B2
(45) Date of Patent: Oct. 9, 2012

(54) LASER FIXING DEVICE AND IMAGE FORMING APPARATUS

(75) Inventors: Takashi Matsubara, Ashigarakami-gun (JP); Makoto Furuki, Ashigarakami-gun (JP); Naoyuki Egusa, Ashigarakami-gun (JP); Tetsuro Kodera, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 325 days.

(21) Appl. No.: 12/777,983

(22) Filed: May 11, 2010

(65) Prior Publication Data

US 2011/0158721 A1 Jun. 30, 2011

(30) Foreign Application Priority Data

Dec. 24, 2009 (JP) ..... 2009-291773

(51) Int. Cl.
*G03G 15/20* (2006.01)

(52) U.S. Cl. ..... 399/336; 219/216

(58) Field of Classification Search ..... 399/336–337; 219/216

See application file for complete search history.

(56) References Cited

U.S. PATENT DOCUMENTS

| | | | | |
|---|---|---|---|---|
| 2010/0254738 | A1* | 10/2010 | Kagawa | 399/341 |
| 2011/0038653 | A1* | 2/2011 | Egusa et al. | 399/336 |
| 2011/0064448 | A1* | 3/2011 | Watanabe et al. | 399/92 |
| 2011/0103816 | A1* | 5/2011 | Mitsuoka | 399/67 |
| 2011/0116851 | A1* | 5/2011 | Tanaka et al. | 399/336 |
| 2011/0222935 | A1* | 9/2011 | Egusa et al. | 399/336 |
| 2011/0222936 | A1* | 9/2011 | Matsubara et al. | 399/336 |
| 2011/0262196 | A1* | 10/2011 | Maeda | 399/336 |
| 2012/0045239 | A1* | 2/2012 | Maeda | 399/67 |
| 2012/0076557 | A1* | 3/2012 | Matsubara et al. | 399/336 |

FOREIGN PATENT DOCUMENTS

| | | | |
|---|---|---|---|
| JP | 53-054034 A | | 5/1978 |
| JP | 58-028764 A | | 2/1983 |
| JP | 59128569 A | * | 7/1984 |
| JP | 59-204073 A | | 11/1984 |
| JP | 62-038460 A | | 2/1987 |
| JP | 09-034307 A | | 2/1997 |

* cited by examiner

*Primary Examiner* — David Gray
*Assistant Examiner* — G. M. Hyder
(74) *Attorney, Agent, or Firm* — Sughrue Mion, PLLC

(57) ABSTRACT

A laser fixing device includes: a laser beam irradiating device which irradiates a recording medium that is conveyed while carrying an unfixed toner image, with a laser beam; and a laser beam absorbing member which is disposed in an optical path of the laser beam that is emitted to a back side of a position where the recording medium is conveyed, and which absorbs the laser beam.

13 Claims, 9 Drawing Sheets

LASER FIXING DEVICE AND IMAGE FORMING APPARATUS

CROSS-REFERENCE TO RELATED APPLICATIONS

This application is based on and claims priority under 35 USC 119 from Japanese Patent Application No. 2009-291773 filed on Dec. 24, 2009.

BACKGROUND

Technical Field

The present invention relates to a laser fixing device and an image forming apparatus.

SUMMARY

According to an aspect of the invention, there is provided a laser fixing device including: a laser beam irradiating device which irradiates a recording medium that is conveyed while carrying an unfixed toner image, with a laser beam; and a laser beam absorbing member which is disposed in an optical path of the laser beam that is emitted to a back side of a position where the recording medium is conveyed, and which absorbs the laser beam.

BRIEF DESCRIPTION OF THE DRAWINGS

Exemplary embodiments of the present invention will be described in detail based on the following figures, wherein.

DESCRIPTION OF REFERENCE NUMERALS AND SIGNS

1: image forming apparatus, 10: sheet conveying section, 11: winding roller, 20: image forming section, 21: image forming unit, 22: photosensitive drum, 23: charging device, 24: exposing device, 25: transfer roll, 26: cleaning device, 27: developing device, 28: toner replenishment container, 30: fixing section, 31: laser fixing device, 32: laser beam irradiating device, 33: laser beam, 33*a:* primary irradiated area with laser beam, 33*b:* light which is reflected and scattered at primary irradiated area, 33*c:* light which is transmitted through continuous sheet, 35: front-side light collecting member, 35*a:* slit which is disposed in front-side light collecting member, 35*b:* reflecting surface of front-side light collecting member, 36: back-side light collecting member, 36*a:* opening of back-side light collecting member, 36*b:* reflecting surface of back-side light collecting member, 38: conveying roll, 39: discharging roll, 40: laser beam absorbing member, 41: introduction port of laser beam absorbing member, 42: groove-like concave portion of laser beam absorbing member, 42*a:* bottom face of groove-like concave portion, 43: convex portion in groove-like concave portion, 43*a:* sharp-pointed portion of convex portion, 43*b:* inclined face of convex portion, 51: laser fixing device, 52: laser beam irradiating device, 53: laser beam, 53*a:* primary irradiated area, 55: front-side light collecting member, 56: back-side light collecting member, 60: laser beam absorbing member, 71: laser fixing device, 72: laser beam irradiating device, 73: laser beam, 73*a:* primary irradiated area, 77: front-side light collecting member, 76, 77: back-side light collecting member, 80, 81: laser beam absorbing member, 100: flash lamp fixing device, 101: flash lamp, 102: mirror

DETAILED DESCRIPTION

Figure 1:
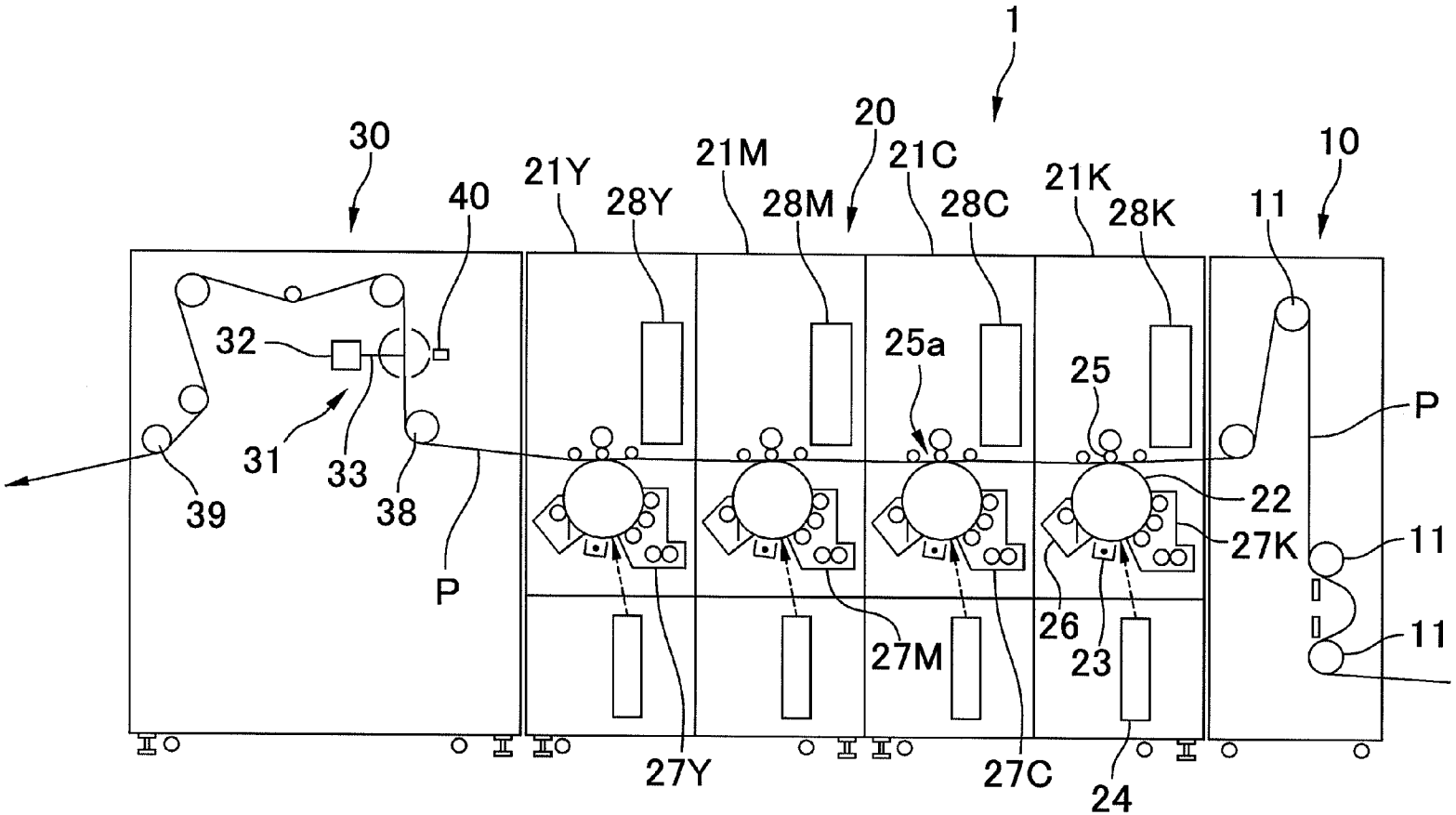
FIG. 1 is a schematic diagram of an image forming apparatus which is an exemplary embodiment of the invention.

FIG. 1 is a schematic diagram of an image forming apparatus which is an exemplary embodiment of the invention.

The image forming apparatus 1 is a large apparatus which forms an image on a continuous sheet (also called a continuous business form, hereinafter referred to simply as "continuous sheet") which functions as a recording medium, and configured by: a sheet conveying section 10 which conveys and feeds the continuous sheet P; an image forming section 20 which forms a toner image, and which transfers the toner image to the continuous sheet P; and a fixing section 30 which fixes the transferred image.

The sheet conveying section 10 includes a plurality of winding rollers 11 around which the continuous sheet P is wound to be conveyed, and is configured so as to convey the continuous sheet P to the image forming section 20 while applying a tension to the continuous sheet.

In the image forming section 20, four image forming units 21K, 21C, 21M, 21Y in which toner images that are visible images are formed respectively by adhesion of toners (image forming materials) of black (K), cyan (C), magenta (M), and yellow (Y) are sequentially arranged starting from the upstream side at regular intervals in the direction of conveying the continuous sheet.

Each of the image forming units 21K, 21C, 21M, 21Y includes a photosensitive drum 22 in which an optical conductive layer is formed on the outer circumferential surface of a cylindrical member made by a conductive material, and, around the photosensitive drum 22, also includes: a charging device 23 which uniformly charges the surface of the photosensitive drum 22; an exposing device 24 which irradiates the charged photosensitive drum 22 with image light to form a latent image on the surface; a developing device 27 which causes to a toner to be moved to the latent image on the photosensitive drum 22, thereby forming a toner image; a transfer roll 25 which is opposed to the photosensitive drum 22, and which transfers the toner image formed on the photosensitive drum to the continuous sheet; and a cleaning device 26 which removes a toner remaining on the photosensitive drum 22 that has undergone the transfer of the toner image.

In the four image forming units 21K, 21C, 21M, 21Y, toners housed in the respective developing devices 27 are different from one another. The units are identical to one another in the other configuration. Above the developing devices 27K, 27C, 27M, 27Y, toner replenishment containers 28K, 28C, 28M, 28Y which replenish toners of colors corresponding to the colors of toners housed in the developing devices are respectively disposed, so that toners which are consumed in the developing processes can be replenished.

In the fixing section 30 which is disposed downstream of the image forming section 20, disposed are: a laser fixing device 31 which fixes the unfixed toners that are transferred onto the continuous sheet by the image forming section 20; a conveying roll 38 around which the continuous sheet P onto which the toner images are transferred is wound, and which guides the continuous sheet to the laser fixing device; and a discharging roll 39 which discharges the continuous sheet P onto which the toner images are fixed, to the outside of the apparatus.

In the image forming apparatus, when the image forming operation is started, the surface of the photosensitive drum 22 is charged substantially uniformly with a negative polarity by the charging device 23. Based on image data, the exposing device 24 irradiates the circumferential surface of the charged photosensitive drum 22, with the image light. Therefore, a latent image due to the potential difference between an exposed portion and a non-exposed portion is formed on the surface of the photosensitive drum 22. In the developing device 27, a thin layer of the developer is formed on the circumferential surface of a developing roll, and the toner in the form of the thin layer is conveyed to a developing position where the developing roll is opposed to the circumferential surface of the photosensitive drum 22, by the rotation of the developing roll. In the developing position, an electric field is formed between the photosensitive drum 22 and the developing roll, and, in the electric field, the toner on the developing roll is moved to the latent image on the photosensitive drum, to form a toner image. The thus formed toner image is conveyed to a transfer press contact portion 25*a* where the transfer roll 25 is press contacted with photosensitive drum, by the rotation of the photosensitive drum 22.

On the other hand, the continuous sheet P which is conveyed from the sheet conveying section 10 is fed to the transfer press contact portion 25*a*. In the transfer press contact portion 25*a*, an electric field is formed by a transfer bias voltage, and, in the electric field, the toner image is transferred to the continuous sheet P. The continuous sheet P is sequentially conveyed to the transfer press contact portions 25*a* of the image forming units 21, and the toner images of the colors are overlappingly transferred.

The continuous sheet P onto which the toner images are transferred is sent in a state where the toner images are carried on the sheet, to the laser fixing device 31 while being wound around the conveying roll 38. In the laser fixing device 31, the conveyed continuous sheet P is irradiated with a laser beam 33 to heat the toners, thereby fixing the toners. The continuous sheet P to which the toner images are fixed is discharged to the outside of the apparatus by the discharging roll 39.

Figure 2:
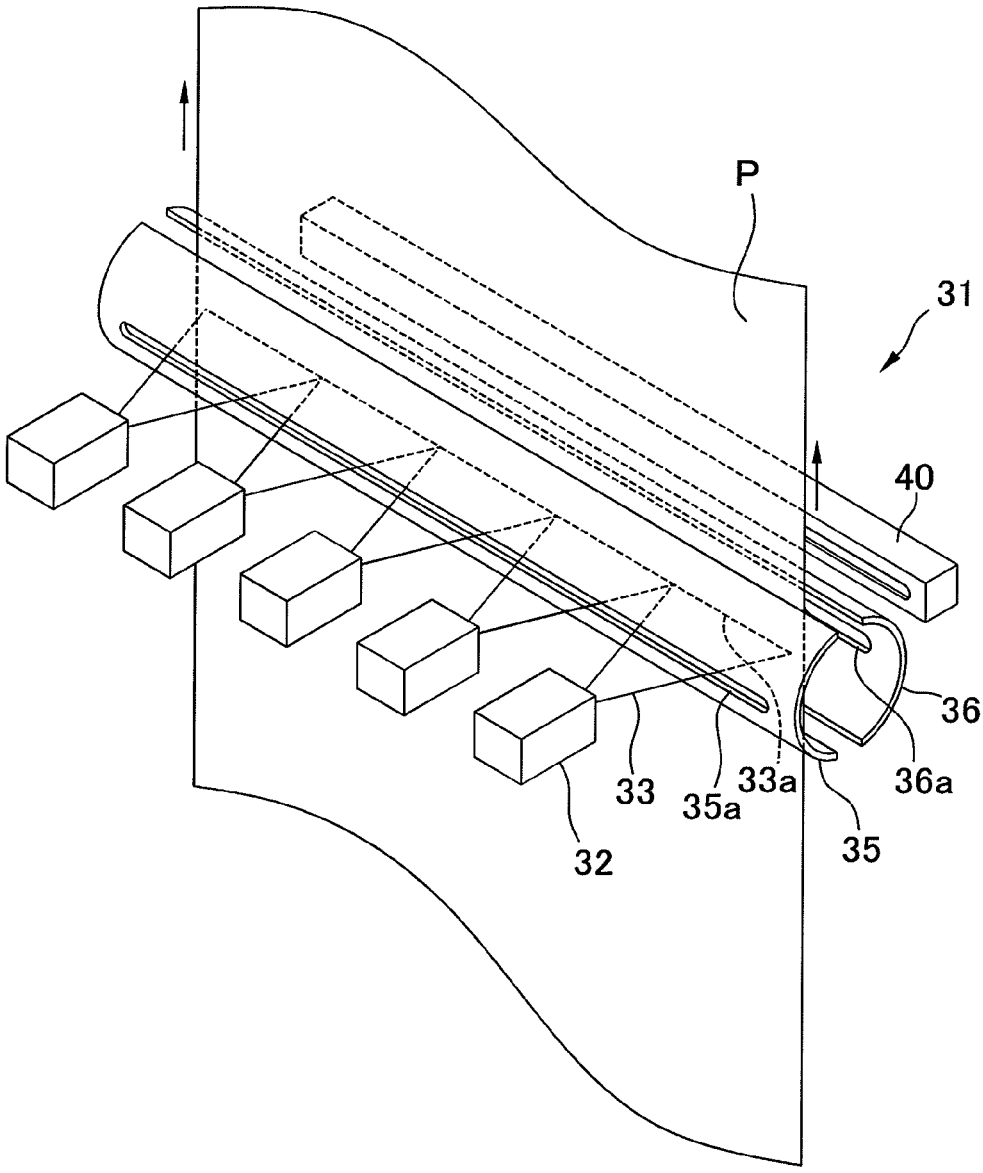
FIG. 2 is a schematic perspective view of a laser fixing device which is used in the image forming apparatus shown in FIG. 1, and which is an exemplary embodiment of the invention.
Figure 3:
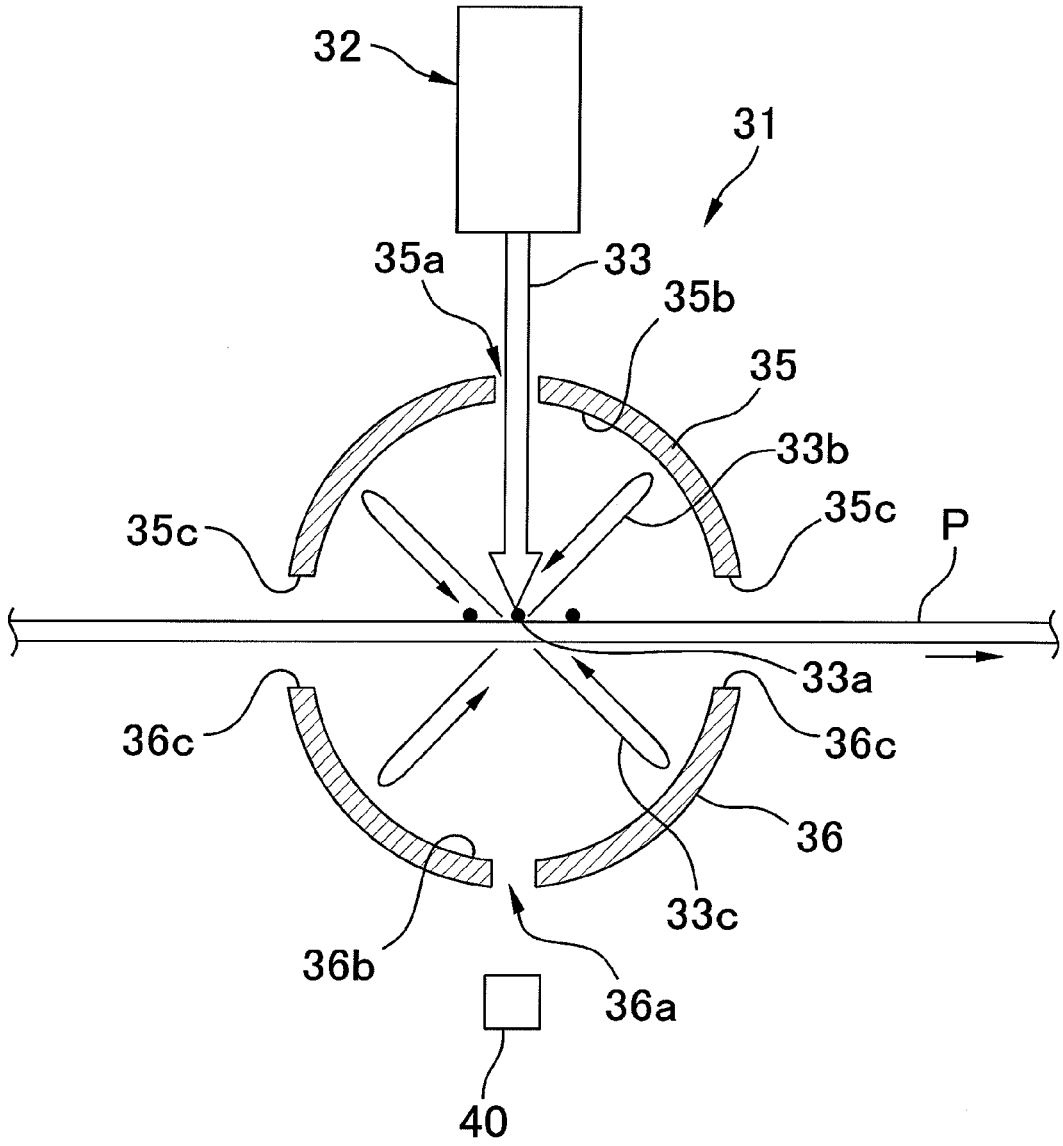
FIG. 3 is a schematic sectional view of the laser fixing device shown in FIG. 2.
Figure 4:
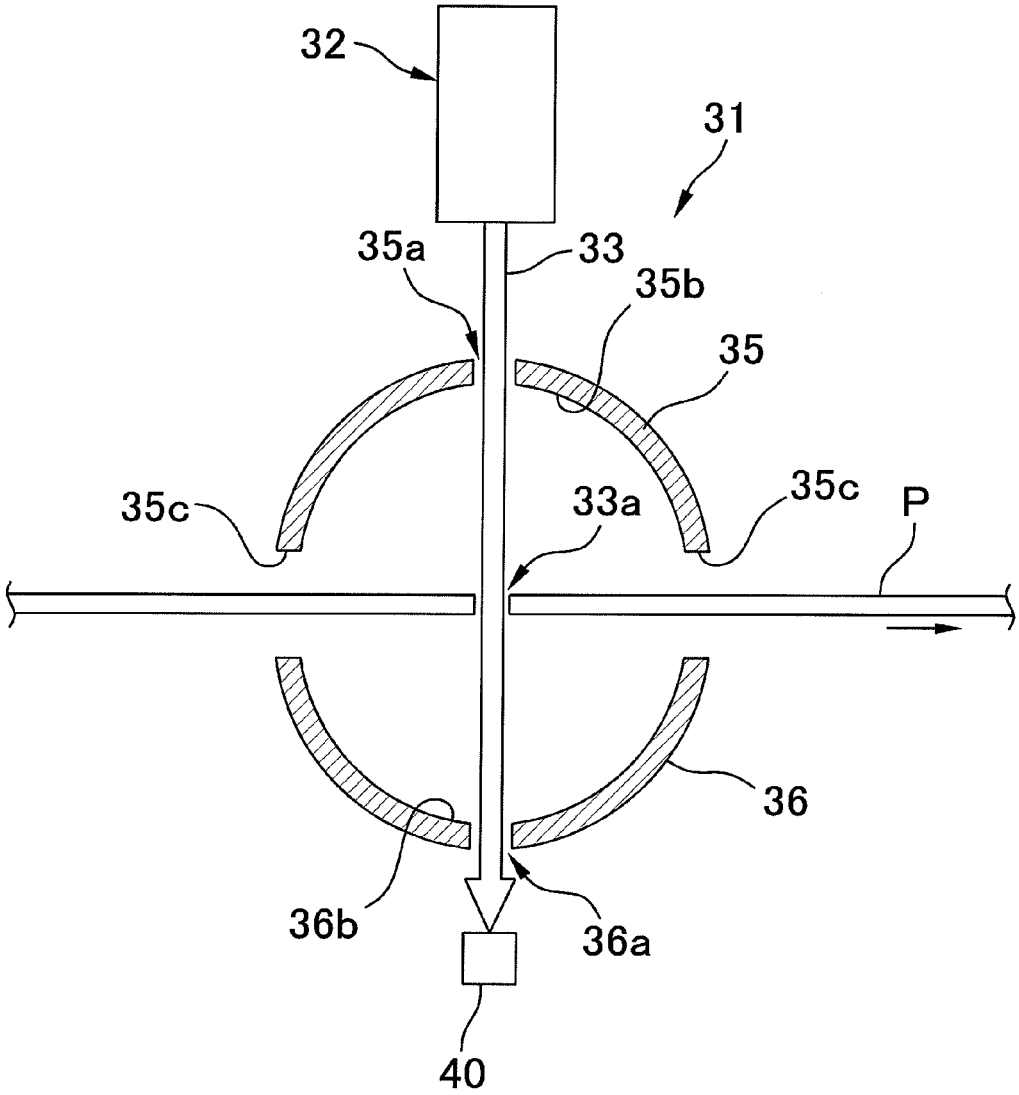
FIG. 4 is a schematic sectional view showing a state where, in the laser fixing device shown in FIG. 2, an emitted laser beam is passed through a conveying position for a continuous sheet.

FIG. 2 is a schematic perspective view of the laser fixing device which is an exemplary embodiment of the invention, FIG. 3 is a schematic sectional view, and FIG. 4 is a schematic sectional view showing a state where an emitted laser beam is passed through a conveying position for the continuous sheet.

In the laser fixing device 31, the main portion is configured by: laser beam irradiating devices 32 which irradiate the whole width of the region of the moving continuous sheet P onto which images are transferred, with the laser beams 33; a front-side light collecting member 35 which causes scattered light 33*b* that is produced by reflection of the laser beams 33 from the continuous sheet P, to again irradiate the continuous sheet P with the scattered light 33*b*; a back-side light collecting member 36 which reflects light 33*c* that is transmitted through the continuous sheet P to be scattered, to, from the back side of the continuous sheet P, collect the light into the back face of an irradiated area of the continuous sheet P or the vicinity thereof; and a laser beam absorbing member 40 which absorbs laser beams that are passed through the position where the continuous sheet is conveyed.

A plurality of laser beam irradiating devices 32 are arranged in the width direction (a direction intersecting with the conveying direction) of the continuous sheet P. The laser beams 33 emitted from the laser beam irradiating devices 32 are adjusted so that the irradiation energy is substantially uniform in the width direction of the moving continuous sheet P. In the moving direction of the continuous sheet P, a preset range of the continuous sheet P is irradiated with the laser beams 33. The irradiation energy is adjusted so that the toners which are passed through the irradiation region of the laser beams 33 are heated to be fixed onto the continuous sheet P.

In the exemplary embodiment, semiconductor lasers are used, and irradiation is performed by a beam width of about 1 mm in the conveying direction of the continuous sheet P.

The front-side light collecting member 35 is a metal mirror in which a reflecting surface 35*b* is a concave cylindrical curved surface, and placed so that the reflecting surface 35*b* is opposed to the continuous sheet P. The front-side light collecting member is supported so that the central axis of the cylindrical curved surface is substantially perpendicular to the conveying direction of the continuous sheet P. In a middle portion in the circumferential direction of the reflecting surface 35*b* which is the cylindrical curved surface, an axial slit 35*a* is disposed to function as an incident port for the laser beams 33. The laser beams 33 is reached to the continuous sheet P through the slit 35*a*. As described above, the laser beam irradiating devices 32 are placed in rear of the front-side light collecting member 35, i.e., on the side opposite to the reflecting surface, so that the beams reflected from the continuous sheet is not blocked, and the front-side light collecting member can be effectively used.

The reflecting surface 35*b* of the front-side light collecting member 35 is disposed, in the moving direction of the continuous sheet P, so as to substantially cover the position where the continuous sheet P is initially irradiated with the laser beams 33, i.e., the primary irradiated area 33*a*, and, in the width direction of the continuous sheet P, so as to substantially cover the whole width of the region where an image is formed. The position of the central axis of the cylindrical curved surface of the front-side light collecting member 35 is set to the primary irradiated area 33*a* where the continuous sheet P is irradiated with the laser beams, or the vicinity of the primary irradiated area. According to the configuration, as shown in FIG. 3, the front-side light collecting member 35 can cause most of the scattered light 33*b* that is produced by reflection of the laser beams 33 from the continuous sheet, to be repeatedly reflected so as to be collected at the primary irradiated area 33*a*, or the vicinity thereof.

The terms "collected at the primary irradiated area or the vicinity thereof" mean that, with respect to the irradiation energy due to the primary irradiation of the laser beams, particularly with respect to isolated toners, light is collected to a degree at which the effect of fixing toner particles at the primary irradiated area is enhanced by addition of the energy of the light which is reflected and collected by the light collecting member. In addition to the case where the light which is collected by the light collecting member accurately reaches to the primary irradiated area, therefore, the light may reaches to the primary irradiated area and the vicinity thereof, or the peak position of the distribution of the irradiation energy of the light which is collected by the light collecting member may be somewhat deviated from the primary irradiated area.

The position of the central axis of the reflecting surface 35*b* which is the cylindrical curved surface may be somewhat deviated in the moving direction of the continuous sheet P or in the direction perpendicular to the surface of the continuous sheet, as far as the scattered light reflected at the primary irradiated area 33*a* can be collected to the vicinity of the primary irradiated area.

In the exemplary embodiment, the cylindrical curved surface of the front-side light collecting member 35 has a radius of 50 mm, and the gap between the both ends 35*c* in the circumferential direction and the conveyed continuous sheet is 5 mm.

As shown in FIGS. 3 and 4, the back-side light collecting member 36 is disposed so as to cover the back side of the primary irradiated area 33*a* for the continuous sheet P, and, in the width direction of the continuous sheet P, so as to cover the whole width of the region where an image is formed. Similarly with the front-side light collecting member 35, the back-side light collecting member 36 is a metal mirror in which a reflecting surface 36*b* is a concave cylindrical curved surface, and placed so that the central axis of the cylindrical curved surface is substantially perpendicular to the conveying direction of the continuous sheet P. The central axis of the cylindrical curved surface is set to the primary irradiated area 33*a* where the continuous sheet P is irradiated with the laser beams, or the vicinity of the primary irradiated area. According to the configuration, the back-side light collecting member 36 can cause most of the scattered light 33*c* that is produced by passing of the laser beams 33 through the continuous sheet P, to be collected to the back side of the primary irradiated area 33*a,* or the vicinity thereof.

In a middle portion in the circumferential direction of the back-side light collecting member 36 which is formed as a cylindrical curved surface as described above, an opening 36*a* functioning as a laser beam transmission portion which allows the laser beams 33 to be passed axially therethrough is disposed. When the continuous sheet P is not at the primary irradiated area 33*a* with the laser beams, when the continuous sheet is burned out as shown in FIG. 4, or the like, therefore, the laser beams 33 which are passed through the primary irradiated area 33*a* to reach to the side of the back-side light collecting member 36 are passed through the opening 36*a*.

In the exemplary embodiment, the opening 36*a* is disposed in the back-side light collecting member 36 to allow the laser beams 33 to be passed therethrough. Alternatively, the position to which the laser beams 33 reach may be formed by an optically transparent material such as glass.

Figure 5A:
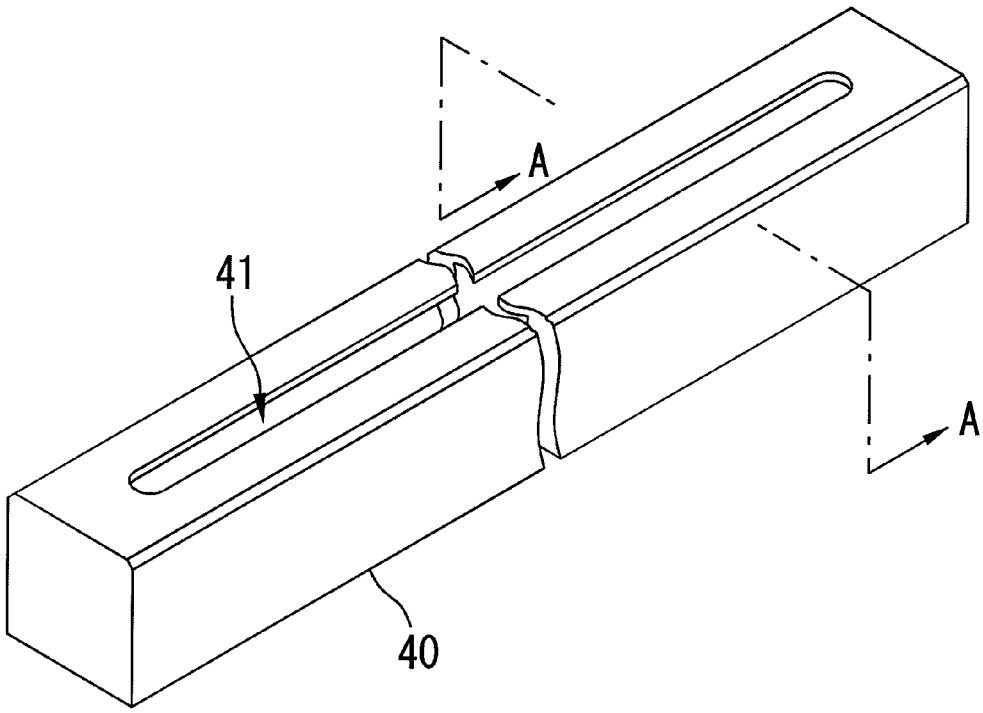
FIG. 5A is a schematic perspective view of a laser beam absorbing member which is used in the laser fixing device shown in FIG. 2.
Figure 5B:
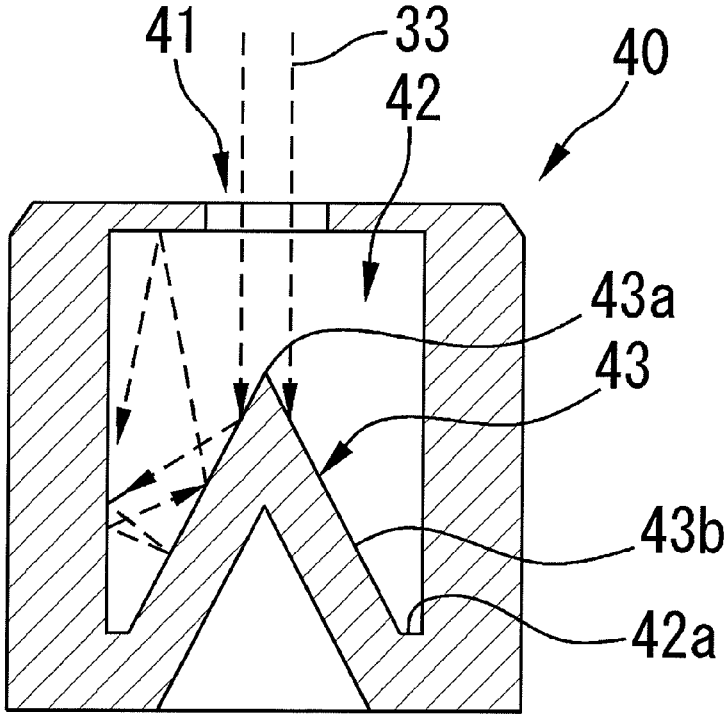
FIG. 5B is a schematic sectional view of the member.

FIGS. 5A and 5B schematically show the laser beam absorbing member 40, FIG. 5A is a schematic perspective view, and FIG. 5B is a sectional view taken along line A-A of FIG. 5A.

The laser beam absorbing member 40 is formed by a heat-resistant material such as ceramics or a metal, and placed to be opposed to the opening 36*a* of the back-side light collecting member 36.

As shown in FIGS. 5A and 5B, the laser beam absorbing member 40 has a substantially parallelepiped outer shape, and includes: an introduction port 41 through which the laser beams 33 are introduced; a groove-like concave portion 42 which is formed continuously from the introduction port 41; and a convex portion 43 which is projected toward the introduction port 41 from the bottom face 42*a* of the groove-like concave portion 42.

The introduction port 41 is disposed at a position opposed to the opening 36*a* of the back-side light collecting member 36, and formed into a size which allows the laser beams 33 that are passed through the opening 36*a,* to be introduced into the port.

In the groove-like concave portion 42, the inner surface is treated so as to absorb the laser beams 33 which is incident through the introduction port 41. When black alumite treatment is applied, for example, reflected light is reduced. Alternatively, a light-absorbing black coating film or the like may be formed. The convex portion 43 is formed inside the groove-like concave portion 42, and similar surface treatment is applied to the convex portion so that also side portions 43*b* of the convex portion have a high light-absorbing property.

As shown in FIG. 5B, the convex portion 43 is disposed to be projected toward the introduction port 41 from the bottom face 42*a* of the groove-like concave portion 42, and the tip end is in the groove-like concave portion and formed as a sharp-pointed portion 43*a* which has a pointed shape. The convex portion 43 has the same section shape in the width direction of the conveyed continuous sheet, and the region extending from the sharp-pointed portion 43*a* to the bottom face 42*a* is formed as an inclined face 43*b.* Therefore, the laser beams 33 which enter from the introduction port 41 into the groove-like concave portion 42 reach to the inclined face 43*b* of the convex portion to be absorbed. As shown in FIG. 5B, also reflected light is repeatedly incident on the inner surface of the groove-like concave portion 42 and the inclined face 43*b* of the convex portion 43 to be absorbed. According to the configuration, light which leaks from the laser beam absorbing member 40 to the outside is reduced.

A cooling device (not shown) may be disposed outside the laser beam absorbing member 40, and the member may be prevented from being excessively head by the energy of the laser beams 33. As the cooling device, for example, a heat sink may be employed. Alternatively, a cooling fan (not shown) which blows an air flow against the back face of the laser beam absorbing member may be disposed, or both of the devices may be disposed. Means other than the heat sink and the cooling device may be used.

The thus configured laser fixing device 31 functions in the following manner.

When the continuous sheet onto which toner images are transferred is normally conveyed, the continuous sheet is irradiated with the laser beams 33 from the laser beam irradiating devices 32, or namely a limited range centered on the primary irradiated area 33*a* is irradiated. Light which is reflected from the continuous sheet, and that which is passed through the continuous sheet P and scattered on the back side are reflected by the front-side light collecting member 35 and the back-side light collecting member 36, respectively, and again reach to the vicinity of the primary irradiated area. Therefore, toner particles on the continuous sheet are heated and fixed by both the laser beams 33 which are primarily irradiated, and the reflected light from the front-side light collecting member 35 and the back-side light collecting member 36. When the image concentration at the primary irradiated area 33*a* is low, particularly, the amount of light which is reflected from the recording medium and that of light which is transmitted through the continuous sheet P are large, and that of light which again reaches from the front-side light collecting member 35 and the back-side light collecting member 36 is large.

The density of toner particles in a low-concentration portion is low, and hence the heat radiation amount is large, so that the heating efficiency is low. However, the energy of the light, with which toner particles are irradiated, from the front-side light collecting member 35 and the back-side light collecting member 36 as described above is large, and hence the low heating efficiency is improved. In a high-concentration portion, by contrast, the density of toner particles is high, and the amount of reflected light when the laser beams 33 are primarily irradiated is small. Therefore, the energy of the light, with which toner particles are irradiated, is lower than that in a low-concentration portion, and phenomena that excessive heating causes an image defect, and that scattering of the toner resin is increased are suppressed.

Figure 9A:
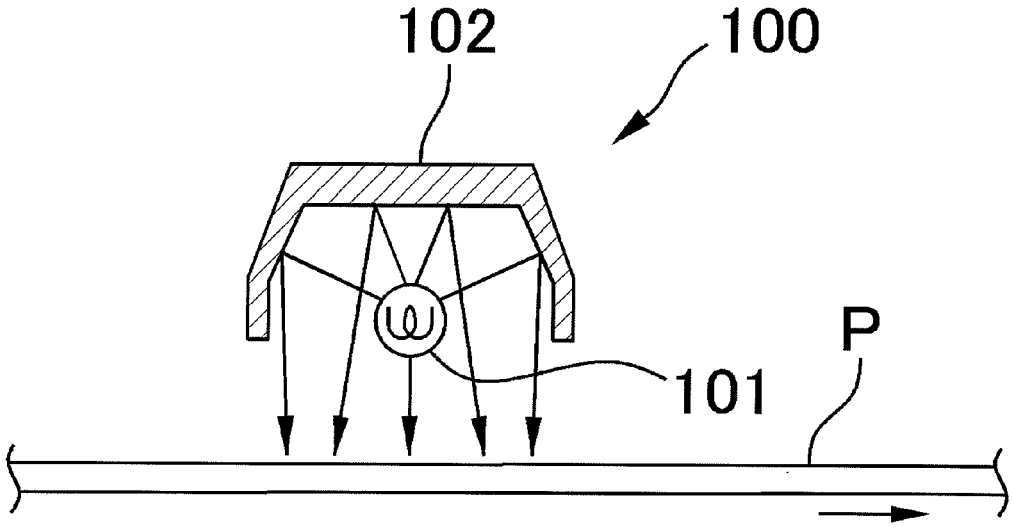
FIGS. 9A and 9B are schematic sectional views showing a conventional flash lamp fixing device.
Figure 9B:
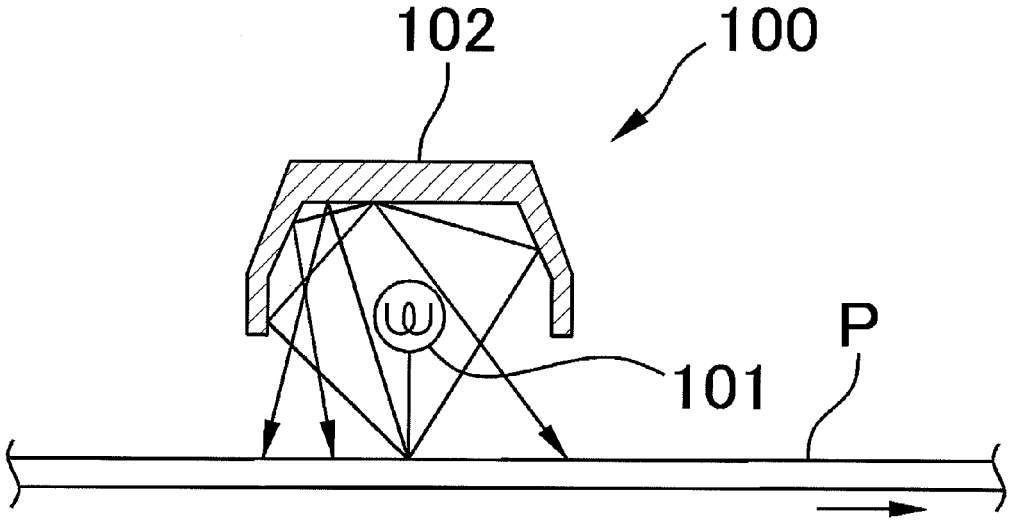

The front-side light collecting member 35 and back-side light collecting member 36 which function as described above are different from a reflecting member of a conventional fixing device 100 that uses a flash lamp such as shown in FIGS. 9A and 9B, in the following points.

In the conventional fixing device 100 that uses a flash lamp, the flash lamp 101 is placed so as to be opposed to the conveyed recording medium P, and a mirror 102 which is a reflecting member is disposed so as to cover the back and side faces of the flash lamp 101. As shown in FIG. 9A, the mirror 102 reflects light which is radiated from the flash lamp 101 toward the periphery, particularly light which is directed toward the back and the lateral side, to cause the light to reach to the recording medium P. At this time, light reflected from the mirror 102 reaches to a wide region opposed to the flash lamp 101 while being distributed. As shown in FIG. 9B, the device has also a function of further reflecting the light with which the recording medium is irradiated and which is reflected therefrom, and causing the light to reach to the recording medium. However, light beams having different incident angles are reflected as they are, but not collected into a specific region. Therefore, the irradiation energy is substantially uniformly supplied to the region of the recording medium P opposed to the flash lamp 101, and, even in the case where high- and low-concentration portions mixedly exist in toner images of the recording medium P opposed to the flash lamp 101, the supplied energy is substantially uniform.

Therefore, the front-side light collecting member 35 or back-side light collecting member 36 which makes a difference in the energy supplied to toner particles depending on whether the primary irradiated area 33*a* with the laser beams 33 is a high-concentration portion or a low-concentration portion is different in the disposition object from the mirror of the fixing device which uses the flash lamp, and entirely different in function therefrom.

On the other hand, when a failure occurs in the conveyance of the continuous sheet P, the laser fixing device 31 operates in the following manner.

In a laser fixing device, unlike a device using a flash lamp or the like, the straight traveling property of light is high, and also the energy density at the irradiated area with laser beam is high. Therefore, it is possible to realize high-speed fixation in which the conveying speed of a recording sheet is high. Because of the straight traveling and high-output properties of laser beams, however, it is contemplated that, when an abnormality such as paper jamming occurs in conveyance of a recording medium, a continuous sheet which is at the primary irradiated area with the laser beams is burned out for a short time period. In the exemplary embodiment, for example, the laser beams have a beam width of about 1 mm in the conveying direction, and by contrast the continuous sheet P is conveyed at 1 m/sec. When paper jamming occurs, the continuous sheet P at the primary irradiated area 33*a* of the laser beams is burned out after an elapse of several to several tens of milliseconds, and the laser beams 33 are passed toward the back side as shown in FIG. 4. Furthermore, it must be supposed that, when an abnormality occurs in the device, the laser beams 33 are emitted from the laser beam irradiating devices 32 although the continuous sheet is not conveyed. In the case where the continuous sheet P does not exist at the primary irradiated area 33*a* with the laser beams, as described above, the laser beams 33 are passed through the conveying position for the continuous sheet P, and straightly advances to reach the back side while maintaining the irradiation energy at the emission.

The laser beams which are passed through the conveying position for the continuous sheet P are passed through the opening 36 disposed in the back-side light collecting member 36, and guided to the laser beam absorbing member 40 to be absorbed thereby. Even when the continuous sheet P does not exist at the primary irradiated area 33*a* with the laser beams, therefore, the laser beams 33 which are passed through the primary irradiated area 33*a* do not directly reach to other members and the like which are placed in the back side, and hence the members can be prevented from being heated.

Furthermore, it is possible to prevent that the back-side light collecting member 36 is directly irradiated with the laser beams so that the laser beams are reflected therefrom to heat the other members.

Next, a laser fixing device which is a second exemplary embodiment of the invention will be described with reference to FIG. 6.

Similarly with the first exemplary embodiment, in the laser fixing device 51, the main portion is configured by: laser beam irradiating devices 52 which irradiate the moving continuous sheet P with laser beams 53; a front-side light collecting member 55 which causes scattered light that is produced by reflection of the laser beams 53 from the continuous sheet P, to again irradiate the continuous sheet P; a back-side light collecting member 56 which reflects light that is transmitted through the continuous sheet P to be scattered, to, from the back side of the continuous sheet P, collect the light into an irradiated area; and a laser beam absorbing member 60 which, when the continuous sheet does not exist at a primary irradiated area 53*a* with the laser beams, absorbs a laser beam that is passed through the conveying position for the continuous sheet.

The laser beam irradiating devices 52, the front-side light collecting member 55, and the laser beam absorbing member 60 are configured in a similar manner as those of the first exemplary embodiment, and hence their description is omitted.

Similarly with the first exemplary embodiment, the back-side light collecting member 56 is a metal mirror in which a reflecting surface 56*b* is a concave cylindrical curved surface, and placed so that the central axis of the cylindrical curved surface is substantially perpendicular to the conveying direction of the continuous sheet P in the back side of the conveyed continuous sheet. The cylindrical curved surface is formed continuously in the circumferential direction, and, unlike the first exemplary embodiment, an opening is not disposed.

Figure 6:
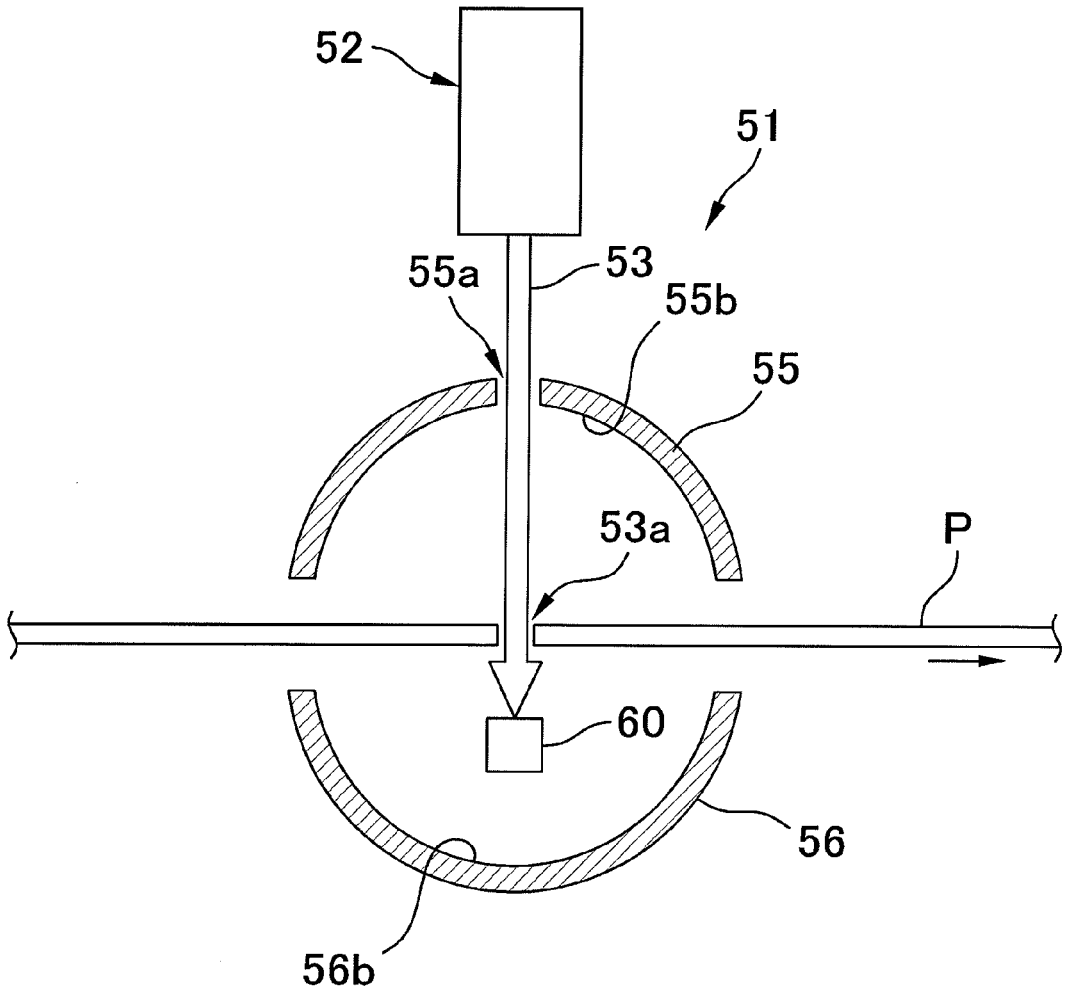
FIG. 6 is a schematic sectional view of a laser fixing device which is a second exemplary embodiment of the invention.

As shown in FIG. 6, the laser beam absorbing member 60 is placed between the conveying position for the continuous sheet P and the back-side light collecting member 56. When the continuous sheet P does not exist at the primary irradiated area 53*a* with the laser beams 53, therefore, the laser beams 53 which are passed through the primary irradiated area 53*a* to be emitted toward the back side are absorbed by the laser beam absorbing member 60 before reaching the back-side light collecting member 56.

Even in the case where, due to a conveyance failure or the like, the same place of the continuous sheet P is irradiated with the laser beams 53 for a period which is longer than that in the normal state and the portion at the primary irradiated area 53*a* is burned out, therefore, it is possible to prevent other members from being excessively heated by the laser beams 53 which are passed through the primary irradiated area 53*a*.

Figure 7:
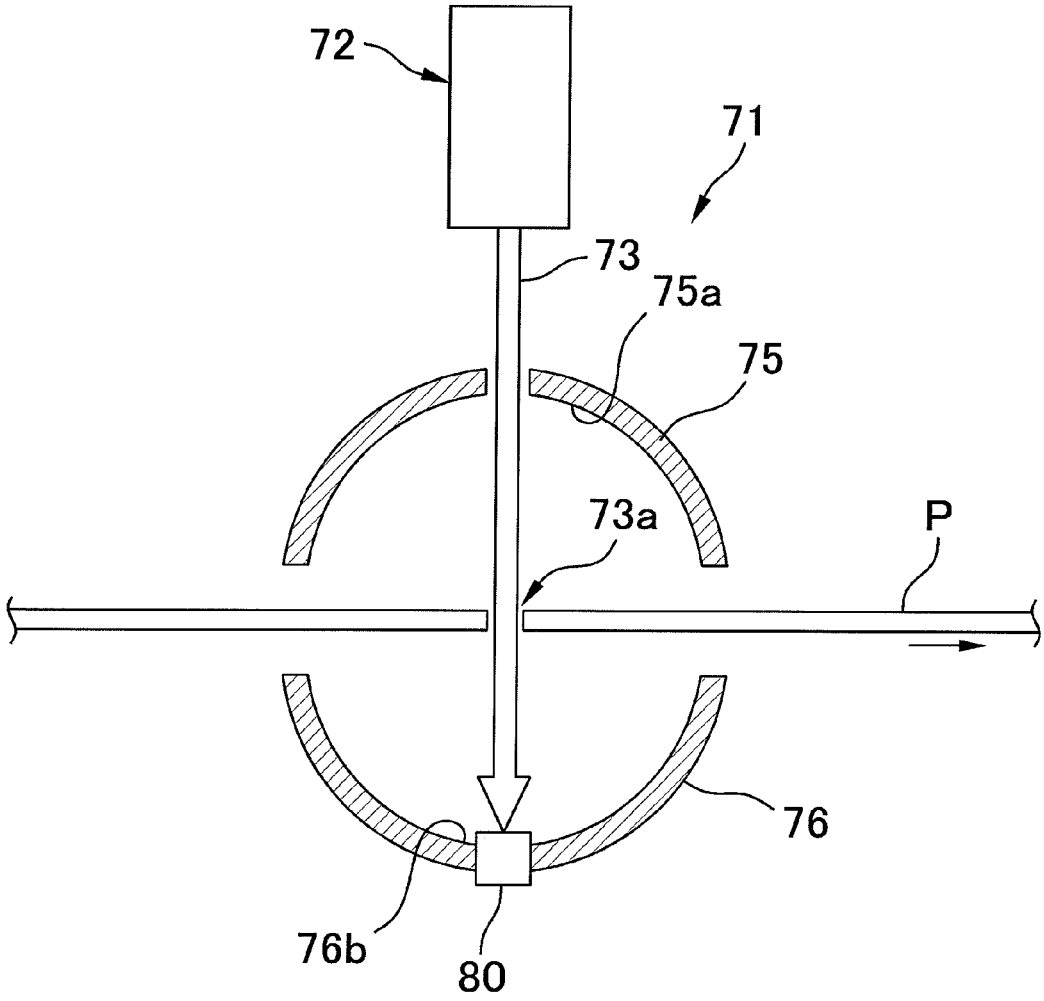
FIG. 7 is a schematic sectional view of a laser fixing device which is a third exemplary embodiment of the invention.

Next, a laser fixing device which is a third exemplary embodiment of the invention will be described with reference to FIG. 7.

Similarly with the first exemplary embodiment, in the laser fixing device 71, the main portion is configured by laser beam irradiating devices 72, a front-side light collecting member 75, a back-side light collecting member 76, and a laser beam absorbing member 80. The laser beam irradiating devices 72, the front-side light collecting member 75, and the laser beam absorbing member 80 are identical with those of the first exemplary embodiment.

Similarly with the first exemplary embodiment, the back-side light collecting member 76 is a metal mirror in which a reflecting surface 76*b* is a concave cylindrical curved surface, and placed so that the central axis is substantially perpendicular to the conveying direction of the continuous sheet P in the back side of the conveyed continuous sheet. As shown in FIG. 7, the laser beam absorbing member 80 is supported in a middle portion in the circumferential direction of the reflecting surface of the back-side light collecting member 76. Namely, the laser beam absorbing member 80 is supported integrally with the back-side light collecting member 76, and absorbs the laser beams 73 which are passed through the primary irradiated area 73*a*.

Figure 8:
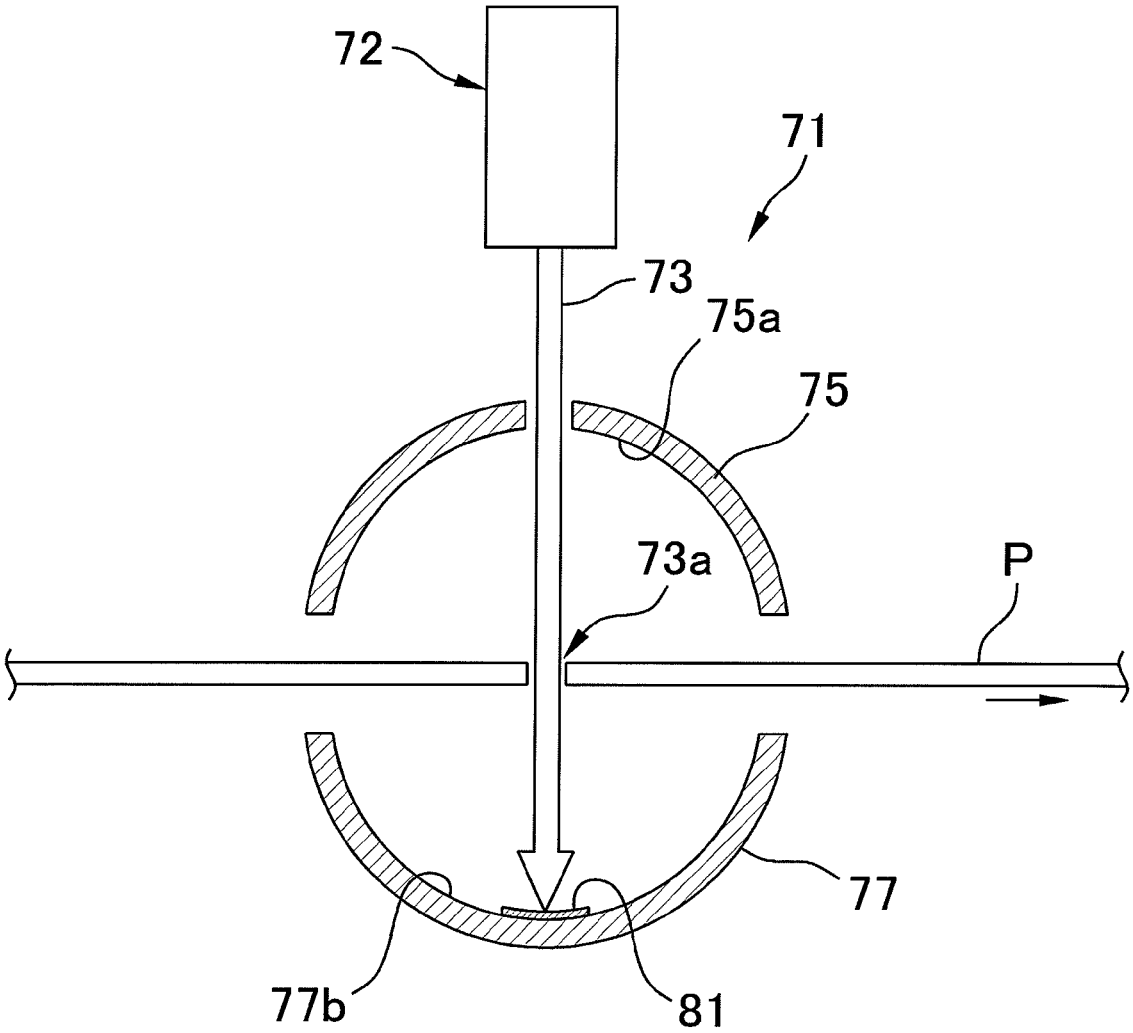
FIG. 8 is a schematic sectional view of a laser fixing device which is a fourth exemplary embodiment of the invention.

In the exemplary embodiment shown in FIG. 6, the member shown in FIGS. 5A and 5B is used as the laser beam absorbing member. By contrast, a configuration may be employed where, as shown in FIG. 8, a back-side light collecting member 77 is continuous in the circumferential direction in a similar manner as the second exemplary embodiment, and a laser beam absorbing member 81 formed by a plate- or sheet-like light-absorbing member is bonded to a position which is irradiated with the laser beams 73. Namely, the laser beam absorbing member 81 may be bonded in a strip-like manner in the axial direction of the reflecting surface of the back-side light collecting member 77 which is formed as a concave cylindrical curved surface.

As described above, the laser beam absorbing members 80, 81 are formed integrally with the back-side light collecting members 76, 77, respectively, whereby structures for supporting the laser beam absorbing members 80, 81 are simplified, and easily produced.

The laser beam absorbing member is not restricted to the members which are used in the above-described exemplary embodiments, and may have another configuration as far as the member has an excellent property of absorbing laser beams, high heat resistance, etc. A continuous sheet is used as the recording medium on which an image is to be formed. Alternatively, recording sheets which are cut to a size based on a usual standard may be conveyed and used one by one.

The laser beams have a beam width of about 1 mm in the direction of conveying the recording medium, the cylindrical curved surfaces of the front-side light collecting member 35 and the back-side light collecting member 36 have a radius of 50 mm, and the gaps between the both ends 35*c*, 36*c* in the circumferential direction of the light collecting members 35, 36 and the conveyed continuous sheet are 5 mm. These dimensions can be adequately changed in a range where the irradiation energy of the laser beams 33 can be effectively used in the fixing of toner images.

The metal mirrors are used as the front and back-side light collecting members. Alternatively, glass mirrors in which a metal such as aluminum is applied or bonded to the rear face of glass, metal coated mirrors in which a metal is vapor-deposited, or the like may be used.

In the exemplary embodiments, the shapes of the reflecting surfaces of the front-side light collecting members 35, 55, 75 and the back-side light collecting members 36, 56, 76, 77 are formed as a concave cylindrical curved surface. However, the shapes are not limited to a concave cylindrical curved surface. For example, the members may have an oval reflecting surface, or may be configured by a circumferential arrangement of a plurality of divided reflecting surfaces. When the shapes of the reflecting surfaces are changed in this way, even in the case where, during conveyance of the continuous sheet, the sheet is vertically displaced, reflected light which is reflected by the light collecting member can reach in a stable amount to the primary irradiated area of the continuous sheet, and uneven fixation can be reduced.

It is not always necessary to dispose the front-side light collecting members 35, 55, 75 and the back-side light collecting members 36, 56, 76, 77. In order to effectively use the energy of the laser beams, however, it is preferred to dispose the light collecting members.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A laser fixing device comprising:

a laser beam irradiating device which irradiates a recording medium that is conveyed while carrying an unfixed toner image, with a laser beam; and a laser beam absorbing member which is disposed in an optical path of the laser beam that is emitted to a back side of a position where the recording medium is conveyed, and which absorbs the laser beam.

2. The laser fixing device according to claim 1, wherein the laser fixing device further comprises a back-side light collecting member which reflects light to cause the light to be collected to a back face of an irradiated area of the recording medium or a back face of a vicinity of the irradiated area of the recording medium, the light being emitted from the laser beam irradiating device to the recording medium and transmitted to a back side of the recording medium to be scattered, the back-side light collecting member is disposed to surround the back side of the irradiated area of the recording medium, a laser beam transmission portion through which the laser beam transmits is disposed at a predetermined position of the back-side light collecting member, the predetermined position being in an optical path of the laser beam which is passed to the back side of the recording medium, and the laser beam absorbing member is disposed in rear of the laser beam transmission portion.

3. The laser fixing device according to claim 2, wherein the laser beam irradiating device irradiates the recording medium in a strip-like region which extends in a width direction of the conveyed recording medium, the laser beam absorbing member has: a groove-like concave portion into which the laser beam that is passed through the recording medium is introduced from an introduction port; and an in-groove convex portion which is projected in the groove-like concave portion toward the introduction port from a bottom of the groove-like concave portion and in which a tip end is sharpened and a side face is inclines, and a wall face in the groove-like concave portion and the side face of the in-groove convex portion are surface treated to absorb the laser beam.

4. The laser fixing device according to claim 2, wherein the laser fixing device further comprises a front-side light collecting member which reflects light to cause the light to be collected so as to again irradiate an irradiated area of the recording medium or a vicinity of the irradiated area of the recording medium, the light being emitted from the laser beam irradiating device and reflected from the recording medium.

5. The laser fixing device according to claim 1, wherein the laser fixing device further comprises a back-side light collecting member which reflects light to cause the light to be collected to a back face of an irradiated area of the recording medium or a back face of a vicinity of the irradiated area of the recording medium, the light being emitted from the laser beam irradiating device to the recording medium and transmitted to a back side of the recording medium to be scattered, the back-side light collecting member is disposed to surround the back side of the irradiated area of the recording medium, and the laser beam absorbing member is disposed at a predetermined position which is in the optical path of the laser beam that is emitted to the back side of the recording medium and which is before reaching the back-side light collecting member.

6. The laser fixing device according to claim 5, wherein the laser beam irradiating device irradiates the recording medium in a strip-like region which extends in a width direction of the conveyed recording medium, the laser beam absorbing member has: a groove-like concave portion into which the laser beam that is passed through the recording medium is introduced from an introduction port; and an in-groove convex portion which is projected in the groove-like concave portion toward the introduction port from a bottom of the groove-like concave portion and in which a tip end is sharpened and a side face is inclines, and a wall face in the groove-like concave portion and the side face of the in-groove convex portion are surface treated to absorb the laser beam.

7. The laser fixing device according to claim 5, wherein the laser fixing device further comprises a front-side light collecting member which reflects light to cause the light to be collected so as to again irradiate an irradiated area of the recording medium or a vicinity of the irradiated area of the recording medium, the light being emitted from the laser beam irradiating device and reflected from the recording medium.

8. The laser fixing device according to claim 1, wherein the laser fixing device further comprises a back-side light collecting member which reflects light to cause the light to be collected to a back face of an irradiated area of the recording medium or a back face of a vicinity of the irradiated area of the recording medium, the light being emitted from the laser beam irradiating device to the recording medium, and transmitted to a back side of the recording medium to be scattered, the back-side light collecting member is disposed to surround the back side of the irradiated area of the recording medium, and the laser beam absorbing member is supported at a predetermined position of the back-side light collecting member, the predetermined position being in an optical path of the laser beam which is emitted to the back side of the recording medium.

9. The laser fixing device according to claim 8, wherein the laser beam irradiating device irradiates the recording medium in a strip-like region which extends in a width direction of the conveyed recording medium, the laser beam absorbing member has: a groove-like concave portion into which the laser beam that is passed through the recording medium is introduced from an introduction port; and an in-groove convex portion which is projected in the groove-like concave portion toward the introduction port from a bottom of the groove-like concave portion and in which a tip end is sharpened and a side face is inclines, and a wall face in the groove-like concave portion and the side face of the in-groove convex portion are surface treated to absorb the laser beam.

10. The laser fixing device according to claim 8, wherein the laser fixing device further comprises a front-side light collecting member which reflects light to cause the light to be collected so as to again irradiate an irradiated area of the recording medium or a vicinity of the irradiated area of the recording medium, the light being emitted from the laser beam irradiating device and reflected from the recording medium.

11. The laser fixing device according to claim 1, wherein the laser beam irradiating device irradiates the recording medium in a strip-like region which extends in a width direction of the conveyed recording medium, the laser beam absorbing member has: a groove-like concave portion into which the laser beam that is passed through the recording medium is introduced from an introduction port; and an in-groove convex portion which is projected in the groove-like concave portion toward the introduction port from a bottom of the groove-like concave portion and in which a tip end is sharpened and a side face is inclines, and a wall face in the groove-like concave portion and the side face of the in-groove convex portion are surface treated to absorb the laser beam.

12. The laser fixing device according to claim 1, wherein the laser fixing device further comprises a front-side light collecting member which reflects light to cause the light to be collected so as to again irradiate an irradiated area of the recording medium or a vicinity of the irradiated area of the recording medium, the light being emitted from the laser beam irradiating device and reflected from the recording medium.

13. An image forming apparatus having:

an image carrier on which a latent image due to an electrostatic potential difference is formed;

a developing device which moves an image forming material to the latent image formed on the image carrier, thereby forming a visible image;

a transferring device which directly transfers the visible image to a recording medium, or which primarily transfers the visible image to a transfer member and then secondarily transfers the visible image to a recording medium; and a laser fixing device according to claim 1, the laser fixing device heating the image forming material of the visible image transferred to the recording medium, thereby fixing the image forming material to the recording medium.

* * * * *